US006085451A

United States Patent [19]

Riehle

[11] Patent Number: 6,085,451

[45] Date of Patent: Jul. 11, 2000

[54] INFORMATION CARRIER AND METHOD FOR PRODUCING IT

[75] Inventor: Harald Riehle, Esslingen, Germany

[73] Assignee: IWA F. Riehle GmbH & Co., Denkendorf, Germany

[21] Appl. No.: 09/137,184

[22] Filed: Aug. 20, 1998

[30] Foreign Application Priority Data

Aug. 20, 1997 [DE] Germany ..... 197 36 161

[51] Int. Cl.[7] ..... G09F 11/04

[52] U.S. Cl. ..... 40/495; 434/404

[58] Field of Search ..... 40/377, 495; 116/223, 116/298; 434/404

[56] References Cited

U.S. PATENT DOCUMENTS

| | | | |
|---|---|---|---|
| 2,016,445 | 10/1935 | Massey | 40/495 |
| 4,373,281 | 2/1983 | Sebastian | 40/495 X |
| 4,559,253 | 12/1985 | Thallinger | 40/495 X |
| 4,958,455 | 9/1990 | Jacobsen | 40/495 |
| 5,152,090 | 10/1992 | Jacobsen | 40/495 |
| 5,788,069 | 8/1998 | Calhoun, III et al. | 206/308.1 X |
| 5,908,109 | 6/1999 | Muto | 206/308.1 |

FOREIGN PATENT DOCUMENTS

| | | |
|---|---|---|
| 7109436 | 11/1971 | Germany . |
| 80 13 311 | 8/1980 | Germany . |
| 84 19 274 | 12/1985 | Germany . |

*Primary Examiner*—Joanne Silbermann
*Attorney, Agent, or Firm*—Jones, Tullar & Cooper, P.C.

[57] ABSTRACT

The present invention relates to an information carrier with an upper and a lower cover layer and a plate, which can be moved between the cover layers. The information carrier contains information, which is given a defined association by the appropriate positioning of the plate with respect to the cover layer. In order to be able to produce the information carrier in a more compact and simpler way, it is designed in accordance with the present invention in such a way that the plate (10) is embodied to have a circular disk shape, except for at least one cut off edge section, and can be viewed and manually moved through a cutout in at least one of the cover layers, and is formed out of a center layer arranged between the upper and the lower cover layer by cutting a separating slit in the shape of an arc of a circle. The slit is not continuously closed in itself, but terminates in a lateral narrow side of the center layer, and that the circular disk-shaped plate is bordered in the radial direction by the contour of the center layer, and is rotatably and captively received between the cover layers.

19 Claims, 3 Drawing Sheets

INFORMATION CARRIER AND METHOD FOR PRODUCING IT

FIELD OF THE INVENTION

The present invention relates to an information carrier with an upper and a lower cover layer and a circular disk-shaped plate, which can be moved between the cover layers. The circular disk-shaped plate contains information, wherein the information is given a defined association by the appropriate positioning of the plate with respect to the cover layers, and the plate can be viewed through a cutout in at least one of the cover layers and can be manually rotated, if desired. The present invention further relates to a method for producing the information carrier.

BACKGROUND OF THE INVENTION

An information carrier is known from German Patent Publication DE 31 48 355 C2, wherein the plate which is movable between the cover layers is designed in the form of a sliding tongue, which can be pushed back and forth in the linear direction in the manner of a slide rule between the cover layers.

An information carrier of the type mentioned at the outset is known in the form of the so-called parking disk, wherein a mostly circular disk-shaped plate is made rotatable by means of a rotating connection fixed in place on the cover layers in the manner of a riveted coupling, wherein the circular-shaped plate projects beyond the cover layers over its entire circumferential edge in such a way that it is manually rotatable.

Information carriers of the type mentioned at the outset are also known from German Patent Publications DE 80 13 311 U1, DE-GM 71 09 436 and DE 84 10 274 U1. With these information carriers, the circular disk-shaped plate is seated at its center on a kind of shaft formed by stamped out and folded open tabs or tongues, which are bent out of an outer cover layer and inserted into a centrally punched hole of the rotatable plate. This design is expensive.

OBJECT AND SUMMARY OF THE INVENTION

The object of the present invention is to provide an information carrier of the type mentioned at the outset, which has a very compact appearance and can be produced in a simple, and therefore efficient manner without elaborate assembly work.

This object is attained by means of an information carrier having a circular disk-shaped plate formed from a center layer, arranged between an upper cover layer and a lower cover layer. The circular disk is formed by cutting a separating slit in the shape of an arc of a circle into the center layer. The disk-shaped plate is bordered in the radial direction by the contour of the center layer, so that the center layer constitutes a rotary guidance for the plate without a separate rotary joint element. The plate is rotatably and captively received between the cover layers as a part of the center layer.

Because, in accordance with the present invention, the circular disk-shaped plate is made of a layer of the composite-like information carrier constituting the center layer, the possibility arises of achieving a very accurate and essentially free of play rotary guidance of the circular disk-shaped plate between the cover layers, and in the radial direction by means of the center layer. Because the circular disk-shaped plate is separated only by a separating slit from the center layer, the latter can act in an advantageous manner as a rotary guidance, without it being necessary to have to provide a separate rotary joint element, as in accordance with the parking disk mentioned at the outset, for example.

If the separating slit is not closed on itself in the manner of a circle, but instead terminates at a lateral narrow side of the center layer, or respectively of the information carrier, the manufacture of the information carrier is made considerably more easy. If the separating slit is not closed back on itself, and the respective section of material constituting the center layer is larger than the diameter of the plate to be formed out, the plate at first remains connected to the center layer and can be manipulated by means of it, so that for constructing the composite, the lower layer, the center layer with the circular disk-shaped plate still connected with the latter, and then the upper cover layer can be arranged on top of each other without leading to any difficulties whatsoever with respect to positioning the plate, which is still rigidly connected to the center layer. The plate is separated from the center layer and is rotatable in the composite made of the cover layers and the center layer only when an edge area of the center layer and the plate are separated in such a way that the separating slits, which previously had been cut into the center layer, terminate laterally in the plane of separation.

A particularly compact appearance of the information carrier in accordance with the present invention is achieved when the previously mentioned edge area of the center layer, or respectively of the plate, is separated in such a way that the plate extends flush with the outer edges of the cover layers in this defined rotary position with respect to the cover layers of the plate, and does not protrude from between the cover layers. This position of the rotatable plate could be used as an initial or base state. This can be achieved in an advantageous manner in that the separation of the edge area is performed through all three layers.

The edge area cut off the rotatable plate, by means of which the plate previously had been connected with the center layer, could actually have any arbitrary shape, for example a V-shape, arc shape, etc. However, it has been shown to be particularly advantageous if the rotatable plate has a straight edge along a chord of a circle in the area of the cut-off edge area.

In accordance with a particularly preferred embodiment of the present invention, several edge areas, preferably two edge areas located opposite each other, are cut off the rotatable plate, or respectively center layer, in order to remove further interruptions of the previously made separating slit in the center layer.

It is a further object of the present invention to make available a method for producing an information carrier in accordance with the present invention, which can be executed in a cost-effective manner.

This object is attained by a method which includes the steps of making available two cover layers with at least one cutout and a center layer constituting a rotatable plate; applying a separating slit in the shape of an arc of a circle, which is not closed in itself to the center layer, so that the circular disk-shaped plate being created in the process is connected via at least one segment of an arc of a circle to the center layer; arranging the center layer between the upper and lower cover layers, and connecting the layers with each other in the areas outside of the separating slit; and cutting off an edge area from the center layer and the circular plate in such a way that the connection of the plate with the center layer is cut, and the separating slit in the shape of an arc of a circle terminates in the plane of separation, so that the plate is held captively and rotatably between the cover layers.

In accordance with this, first two cover layers with at least one cutout, as well as a center layer, which is to be arranged between the cover layers, are made available. A separating slit in the shape of an arc of a circle is cut in the center layer which, however, is not closed on itself in at least one area, so that the circular disk-shaped plate being created is connected over at least a segment of the arc of the circle to the center layer. Thereafter, the center layer can be positioned between the upper and the lower cover layer without there being a danger of the circular disk-shaped plate becoming dislodged, displaced or even having to be additionally positioned. The composite layer formed in this way is fixed in place in areas outside of the separating slit, or respectively outside of the circular disk-shaped plate bordered by the separating slit, essentially in any desired manner by connecting the layers with each other, for example by adhesion, high-frequency or ultrasonic welding. Thereafter, an edge area is cut off the center layer, or respectively the circular plate in such a way, that the connection with the center layer is cut or removed, and the separating slit in the shape of an arc of a circle terminates in the plane of separation, so that the plate is captively held between the cover layers and is freely rotatable.

It has been shown to be particularly advantageous if two almost semicircular separating slits are cut for forming the plate from the center layer, which are arranged in such a way that they describe a circular shape, whose free ends are at a distance from each other, so that in these areas two connections, which are located opposite each other with respect to the plate center, of the plate being created, to the center layer are formed, which are cut off after the connection of the layers with each other. An improved connection and handling of the center layer is assured in this way.

It can also prove to be advantageous if the separation of the connection of the plate with the center layer extends through all layers, so that the working of the lateral borders of the cover layers is performed by means of this, and the course of the edge of the rotatable plate in the area of the cut-off edge area extends flush with the lateral boundary of the cover layers.

Preferably two linear separating processes, which are parallel with each other, are performed for cutting off the connection of the plate with the center layer.

Because of the fact that for forming the circular disk-shaped plate out of the center layer a separating slit of finite width is provided, and not simply a cut, an easy moving rotatable arrangement of the circular disk-shaped plate in the composite-like information carrier is achieved. Therefore the separating slit is preferably made by means of machining, for example by milling, or by means of water jet or laser beam techniques. The slit width, i.e. the distance between the wall surfaces which preferably extend essentially perpendicularly with respect to the plane of the layers, or respectively plate, and concentrically with each other, is 0.05 to 0.15 mm.

Further characteristics, details and advantages of the information carrier in accordance with the present invention and of the method for producing it ensue from the following description as well as from the drawing representation of a preferred embodiment of the information carrier and of the method for producing it.

BRIEF DESCRIPTION OF THE DRAWINGS

FIG. 3 is a perspective view of a composite of two cover layers and the center layer in accordance with FIG. 2, with a separating line sketched in;

DETAILED DESCRIPTION OF THE PREFERRED EMBODIMENT

Figure 1:
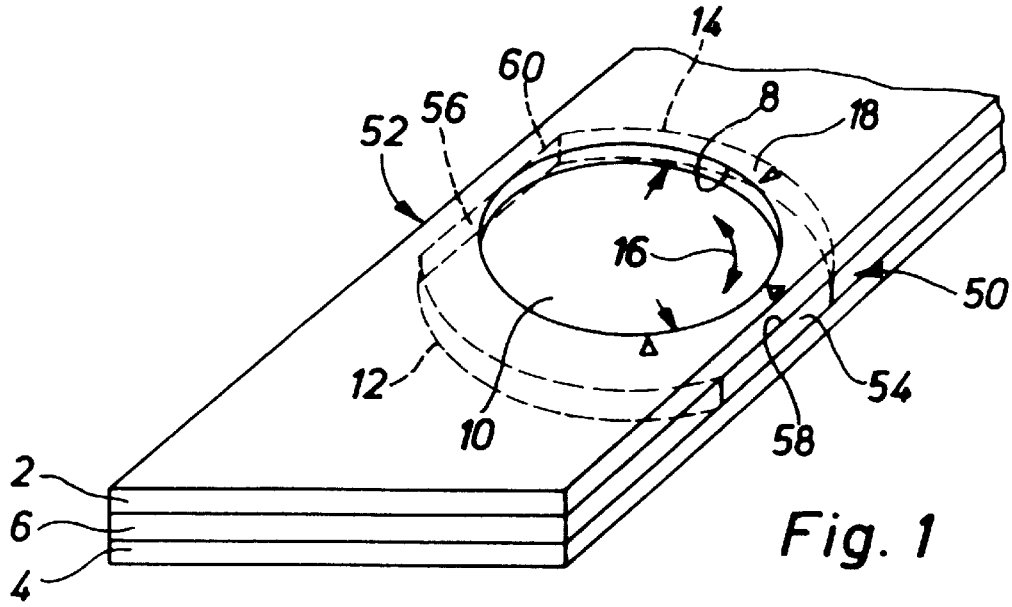
FIG. 1 is a perspective plan view of an embodiment of an information carrier in accordance with the present invention.

FIG. 1 represents an information carrier comprising an upper cover layer 2, a lower cover layer 4 and a center layer 6 arranged between them. A circular cutout 8, enclosed on all sides, is provided in the upper and lower cover layers 2, 4, through which a rotatable plate 10, on which information not represented in the drawings is provided, can be viewed. In a manner which will be described in what follows, the rotatable circular disk-shaped plate 10 is formed from the center layer 6 by the provision of separating slits 12, 14, as well as by means of two further separating processes.

The disk 10 can be manually rotated, i.e. by the action of the fingers of a user, through the cutouts 8 in the upper cover layer 12 and/or the lower cover layer 4, in the direction of the two-headed arrow 16. Depending on the type of information, the plate 10 can be positioned in a defined way in cooperation with information in an area 18 in the shape of a ring on the upper and lower cover layer 2, 4, in order to be able to read information resulting from a defined rotated position of the plate 10. For example, it is possible to provide conversion tables for currencies, length or weight measurements or the like.

Figure 2:
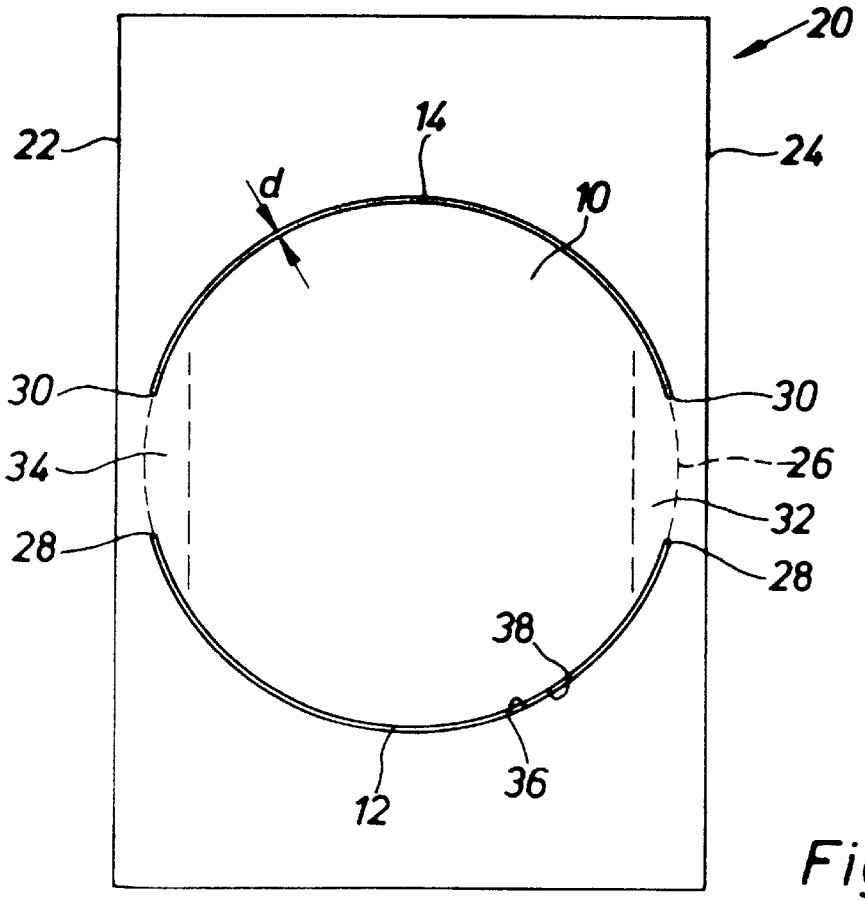
FIG. 2 is a top view of a center layer used for producing the information carrier in accordance with FIG. 1.

FIG. 2 shows a top view of a plate-shaped layer material for producing the center layer 6 of the information carrier. The plate-shaped layer material 20 has been rectangularly cut, wherein the longitudinal sides 22, 24 are of a larger size than the width of the information carrier to be produced. Thereafter, the separating slits 12, 14 in the shape of an arc of a circle mentioned in connection with FIG. 1 are cut, wherein the separating slits 12, 14 are almost semicircularly shaped and arranged in such a way that they lie on a line in the shape of an arc of a circle, indicated by the broken line 26. The free ends 28, 29 of the almost semicircularly shaped separating slits 12, 14, which span 180°, end at a distance from each other, so that the plate 10 of the layer material 20 arranged inside the separating slits 12, 14 is connected at edge areas 32, 34 on both sides with the layer material 20. The separating slits 12, 14 have a width d of approximately 0.1 mm, and are bordered by concentric wall surfaces 36, 38 formed in the course of the cutting of the separating slits.

Figure 3:
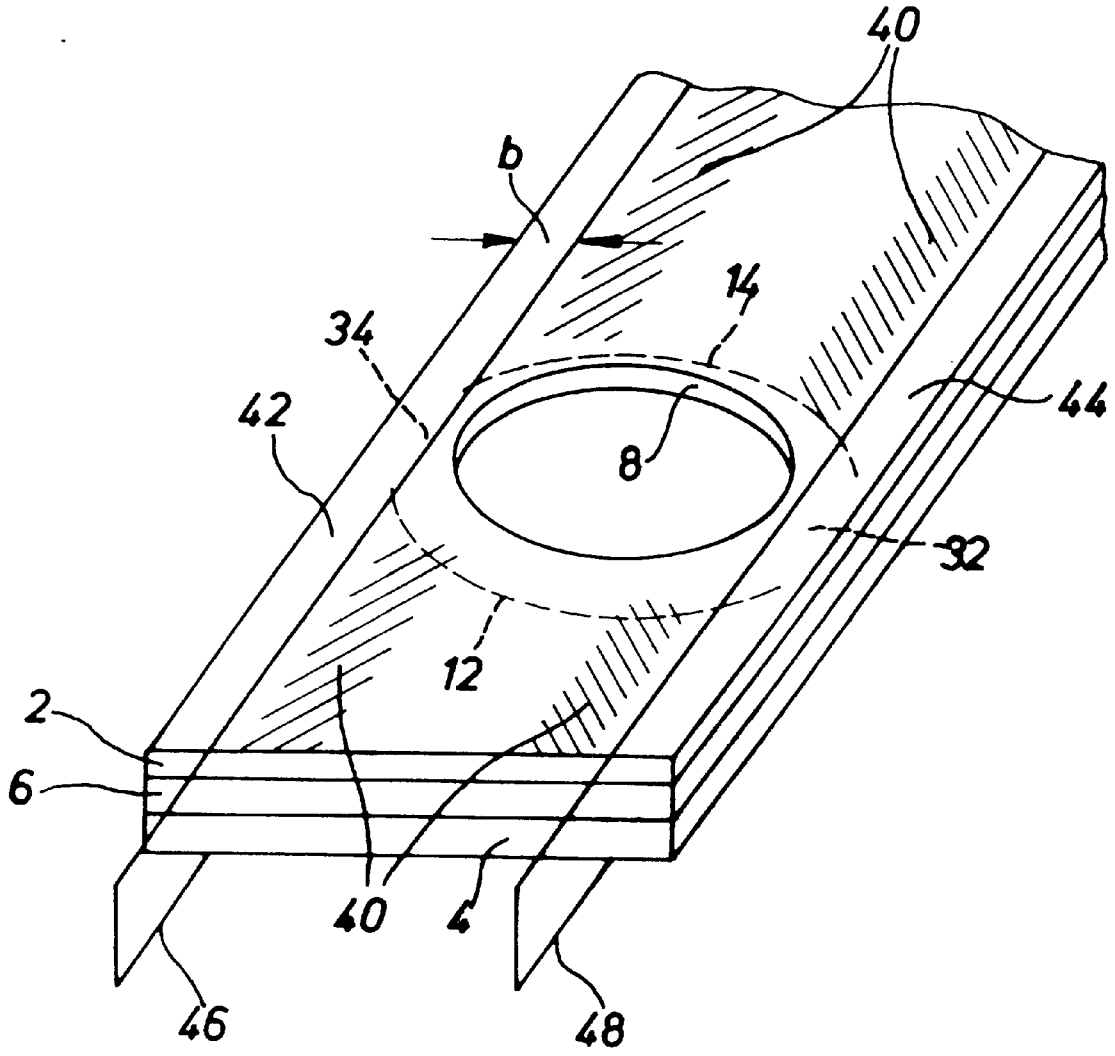

The layer material 20 prepared in this way is arranged as the center layer 6 between the upper and a lower cover layers 2, 4, as represented in FIG. 3. The layers are connected with each other in such a way that they cannot be separated without being destroyed. In this case the connection preferably is made along sections 40 extending in the longitudinal direction and indicated by cross-hatching, which extend outside of the separating slits 12, 14, or respectively the plate 10 bordered by them.

Longitudinal edge areas 42 and 44 are cut off from the composite formed in this way parallel with the longitudinal edges 22, 24 of the center layer 6 along the indicated plane of separation 46, or respectively 48. A circular saw blade, which rotates in the cutting plane 46, 48 is preferably used for this. The width b of the cut off edge areas 42, 44 is sufficiently large here that the edge area 32, 34, which causes the connection of the plate 10 with the layer material 20, is also cut off, so that the separating slits 12, 14 terminate in the lateral surfaces 50, 52 (see FIG. 1). After cutting off the longitudinal edge areas 42, 44, the plate 10 is captively and reversibly received in the composite-shaped information carrier. Except for the cut off edge areas 32, 34, the plate 10 is circular disk-shaped. In the area of the cut off edge areas 32, 34 the plate 10 has flat surfaces 54, 56 in the shape of a chord of a circle, or respectively in a top view an edge 58, 60 in the form of a chord of an arc of a circle.

Figure 4:
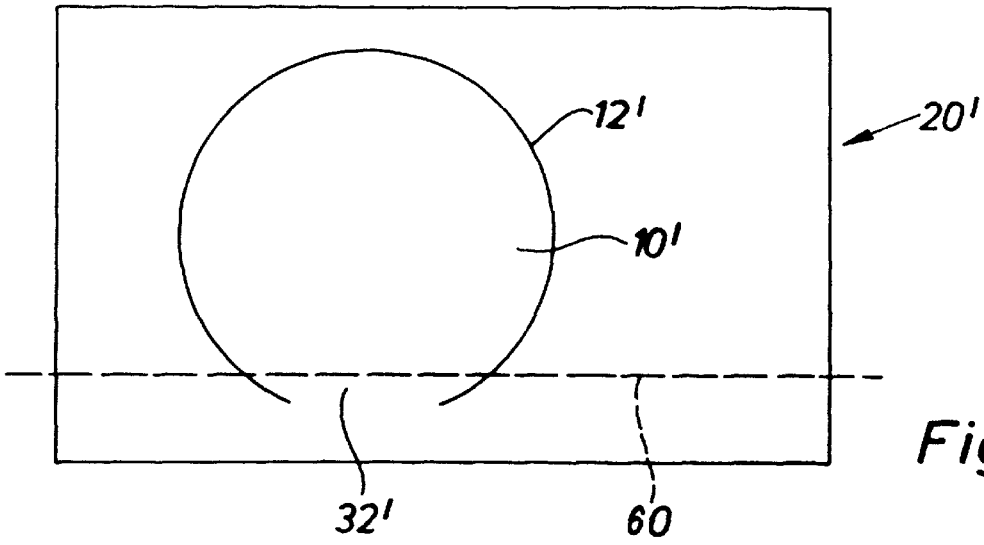
FIGS. 4 to 6 show various representations of possible designs of the rotatable plate in the center layer.
Figure 5:
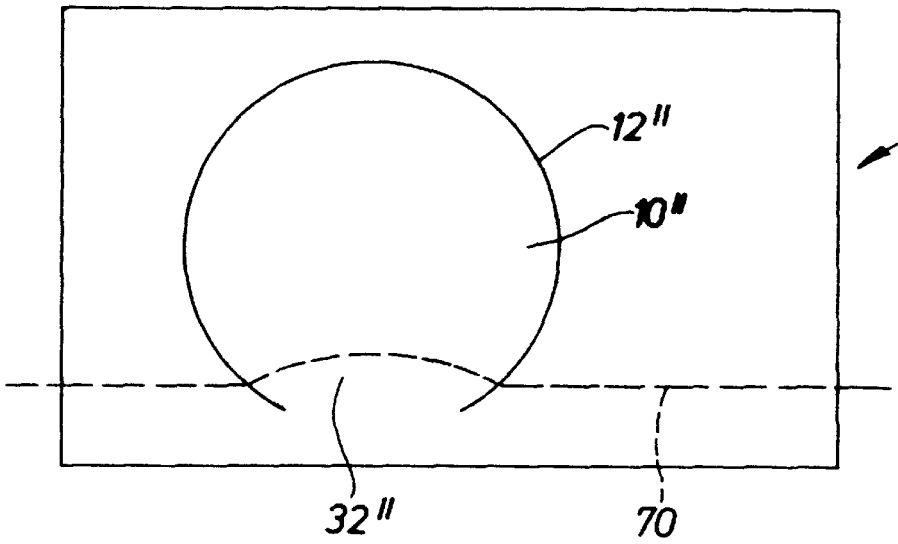
Figure 6:
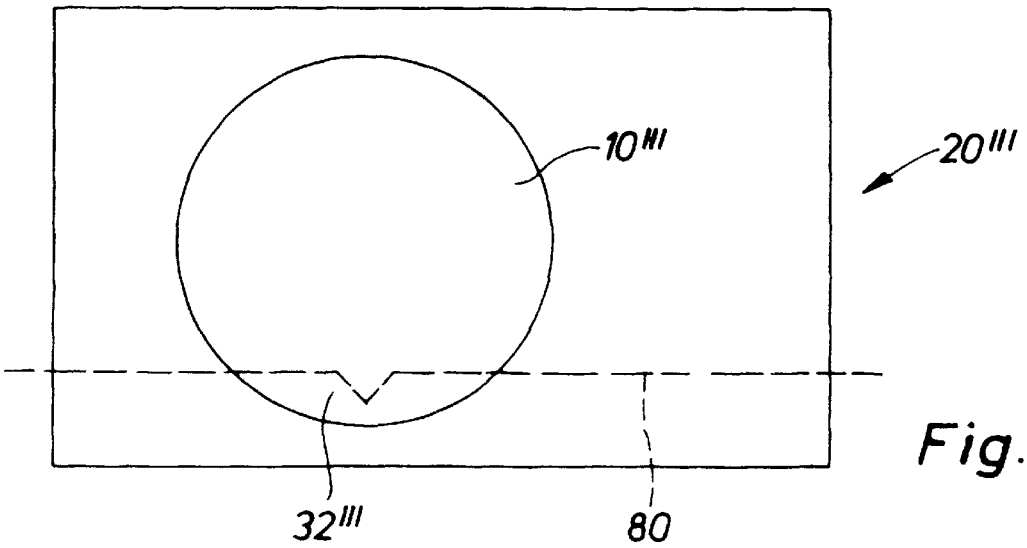

FIGS. 4 to 6 show further possible embodiments of the center layer of the information carrier, wherein only the layer material 20', 20", or respectively 20'" constituting the center layer is represented in a top view. A separating slit 12' in the form of an arc of a circle extends continuously, except for a longitudinal edge area 23', or respectively 32", so that only one connection of the circular disk-shaped plate 10', 10" to the layer material 20', 20" is formed. In this case the ends 28', 30' of the separating slit 12' are correspondingly further apart from each other in order to achieve stability of the plate 10', 10" in the layer material 20', 20".

The course for cutting off the edge areas 32', 32", 32'" is represented by the reference numerals 60, 70, 80, by means of which the rotational mobility of the plate 10', 10", 10'" is achieved. The course 60 is straight, while the course 70 describes a rounded, mouth-shaped cut-off in the area of the plate 10". The course 80 describes an unsteady V-shaped course in the area of the plate 10'". It should be noted that the upper and lower cover layers not represented in FIGS. 4 and 5 can already have their final dimensions from the start, i.e. in this case they are not included in the separating process, or the cut off of the edge areas 32', 32" along the course 60, 70 includes all three layers.

What is claimed is:

1. An information carrier, comprising:

an upper cover layer, said upper cover layer defining outer edges;

a lower cover layer, said lower cover layer defining outer edges; and a center layer, arranged between said upper cover layer and said lower center layer, said center layer having a circular disk-shaped plate formed therein by cutting a separating slit, in the shape of an arc of a circle in said center layer, wherein:

a cutout is provided in at least one of said upper cover layer and said lower cover layer through which said plate can be viewed and by means of which said plate can be manually rotated, said plate containing information given a defined association by the positioning of said plate with respect to said cover layers, said plate being bordered in the radial direction of said plate by the contour of said center layer, said center layer serving as a rotary guide for said plate, and said plate defining two edge areas formed by removing material from said plate, so that said edge areas extend flush with said outer edges of said upper cover layer and said lower cover layer in a defined rotated position of said plate.

2. The information carrier as defined in claim 1, wherein the separation formed by said separation slit extends through all three layers.

3. The information carrier as defined in claim 2, wherein the surfaces of said plate and said center layer at said separating slit face each other.

4. The information carrier as defined in claim 3, wherein the width of said separation slit is 0.5 to 0.15 mm.

5. The information carrier as defined in claim 1, wherein said opposed edge areas define straight edges.

6. The information carrier as defined in claim 1, wherein said edge areas are located opposite to each other.

7. The information carrier as defined in claim 6, wherein said edge areas are parallel to each other.

8. A method for producing an information carrier, comprising the steps of providing an upper cover layer, a lower cover layer and a center layer, with a cutout in at least one of the cover layers;

applying separating slits each in the shape of an arc of a circle, which do not close on themselves, in the center layer, thereby forming a circular disk-shaped plate connected to the remainder of the center layer;

arranging the center layer with the separating slits between the upper cover layer and the lower cover layer, the center layer being connected to both the upper cover layer and the lower cover layer in the areas outside of the separating slits; and cutting off an edge area from the center layer and the circular disk-shaped plate, such that the connection of the circular disk-shaped plate and the center layer is cut, wherein:

said cutting off defining a plane of separation, and the separating slits terminate in said plane of separation, so that the circular plate is held captively and rotatably between the upper cover layer and the lower cover layer.

9. The method as defined in claim 8, wherein the separating slits are applied by cutting two essentially semicircular separating slits, each defining free ends which are spaced apart from each other, forming thereby two connections of the circular disk-shaped plate, which are separated from each other after the upper layer, the bottom layer and the center layer are connected to each other.

10. The method as defined in claim 8, wherein said cutting off extends through all three layers, wherein a lateral trimming of the three layers results.

11. The method as defined in claim 8, wherein said cutting off comprises two linear cuts which are parallel to each other.

12. The method as defined in claim 8, wherein the separating slits are produced by machining.

13. The method as defined in claim 8, wherein the separating slits are produced by water jet separation.

14. The method as defined in claim 8, wherein the separating slits are produced by laser beam separation.

15. The method as defined in claim 8, wherein the edge areas are separated by machining.

16. The method as defined in claim 8, wherein the edge areas are separated by milling.

17. The method as defined in claim 8, wherein the edge areas are separated by sawing cut.

18. The method as defined in claim 8, wherein the edge areas are separated by water jet separation.

19. The method as defined in claim 8, wherein the edge areas are separated by laser beam separation.

* * * * *